US006817844B1

(12) United States Patent
Wang

(10) Patent No.: US 6,817,844 B1
(45) Date of Patent: Nov. 16, 2004

(54) ROTARY BLOWER WITH FORCED EXTERNAL AIR COOLING

(75) Inventor: Qi Wang, Louisville, KY (US)

(73) Assignee: Hi-Bar Blowers, Inc., Fayetteville, GA (US)

( * ) Notice: Subject to any disclaimer, the term of this patent is extended or adjusted under 35 U.S.C. 154(b) by 0 days.

(21) Appl. No.: 10/264,470

(22) Filed: Oct. 4, 2002

(51) Int. Cl.[7] ..... F04B 17/00; F04B 49/00; F04B 23/00; F01C 21/04; E03B 7/07

(52) U.S. Cl. ..... 417/410.4; 417/63; 417/313; 417/201; 418/101; 418/178; 137/557

(58) Field of Search ..... 418/101, 178; 417/410.4, 313, 440, 201, 199.1; 412/63; 137/557

(56) References Cited

U.S. PATENT DOCUMENTS

| | | | | | |
|---|---|---|---|---|---|
| 112,222 | A | * | 2/1871 | Clemens | 137/490 |
| 1,305,964 | A | * | 9/1919 | Dickson | 137/469 |
| 1,386,792 | A | * | 8/1921 | Needham | 418/101 |
| 2,625,106 | A | * | 1/1953 | Hoffman | 417/201 |
| 2,849,988 | A | * | 9/1958 | Nilsson | 418/94 |
| 3,282,495 | A | * | 11/1966 | Walls | 418/122 |
| 4,465,094 | A | * | 8/1984 | Huffhines et al. | 137/557 |
| 4,498,849 | A | * | 2/1985 | Schibbye et al. | 417/299 |
| 5,314,321 | A | * | 5/1994 | Yamamoto et al. | 418/178 |
| 5,401,149 | A | * | 3/1995 | Tsuru et al. | 418/178 |
| 5,496,162 | A | * | 3/1996 | Schnell | 418/101 |
| 5,554,020 | A | * | 9/1996 | Rao et al. | 418/178 |

OTHER PUBLICATIONS

Mark's Standard Handbook for Mechanical Engineers, 10th Ed., McGraw–Hill Co., Boston, MA; 1996, pp. 8–198 and 8–201.*

* cited by examiner

*Primary Examiner*—Justine R. Yu
*Assistant Examiner*—Timothy P. Solak
(74) *Attorney, Agent, or Firm*—Thomas I. Rozsa; Tony D. Chen

(57) ABSTRACT

A rotary blower with forced external air cooling having multiple interconnected and synchronized parallel multi-lobe rotors with the same number of straight lobes for propelling flow from a suction port to a discharge port of an inner casing without internal compression. The blower also has an outer cover with cooling air inlet and outlet openings and added centrifugal cooling fans mounted on the rotor shafts adjacent to the cooling air inlet openings for circulating cooling air through the space between the outer cover and the inner casing. The blower further utilizes wearable strip seal devices applied on the rotors for preventing internal leakage and accidental mechanical contact.

9 Claims, 15 Drawing Sheets

ROTARY BLOWER WITH FORCED EXTERNAL AIR COOLING

BACKGROUND OF THE INVENTION

1. Field of the Invention

The present invention relates generally to the field of mechanical blowers used in industrial applications, and more particularly relates to double rotor lobe type blowers commonly known as rotary blowers.

2. Description of the Prior Art

Rotary blowers are widely used in industrial applications. In blower terminology, 15 to 25 pound per square inch gage (psig) is generally considered relatively high pressure compared to the conventional medium pressure of 5 to 15 psig. High-pressure blowers are widely used, for example, for deep tank aeration in modern wastewater treatment plant, dilute and dense phase pneumatic conveying of bulk materials, or vacuum applications.

However, the high pressure in 15–25 psig range is difficult to obtain in a single stage compression, mainly due to the higher discharge temperature resulted from higher compression ratio, and more leakage flow at a higher pressure differential from blower discharge to suction side through the gaps within the blower. The recycled hot leakage flow raises the inlet temperature, hence further increases the discharge temperature which is already very high due to higher compression ratio.

In addition, from a mechanical point of view, the raised discharge temperature reduces the internal clearances determined by thermal expansion differential so that it could potentially cause rotor rubbing and total seizure failure. The higher temperature of discharge air also raises the temperature of bearings, timing gears and oil, shortening their life or eventually causing total failure.

For those and other reasons, the pressure capability of rotary blower is generally limited to 5 to 15 psig range for a conventional design. However, rotary blowers are widely desired because of its unique performance characteristics due to its rotary positive displacement nature which delivers an almost constant flow at varying pressure levels. The ability of varying pressure at constant flow makes rotary blowers ideal tools for pneumatic conveying applications where material clogging can be quickly cleared with the increase of pressure. Moreover, higher pressure blowers allow the use of smaller pipes to transfer the same amount of material, which reduces the overall size, weight and cost of the application system.

Various approaches have been developed to address the higher temperature problems, such as spraying liquid into the gas stream, including a liquid jacket on the casing where the fluid is circulated and cooled, or using a forced oil lubrication that in turn is cooled by an external heat exchanger. However, many industrial applications prohibit the use of liquid in the gas stream because it can contaminate the application process or the material that is being transferred. In addition, the water jacket method and the forced oil lubrication procedure increase the cost and complexity of the system.

Moreover, while these conventional approaches attempted to deal with the problems of higher pressure blowers, they fail to address the main cause the of the problems, i.e., the internal leakage of the blowers.

Additionally, higher pressure applications also increase the likelihood of leakage at the blower discharge flange. This becomes very critical when the gas is harmful to humans. The conventional low pressure flanges typically have sealing surfaces around not only the pipe wall, but also the bolt pattern. As a result, high torque is required to tighten the bolts for sealing the surface.

Presently, there are two groups of designs for protecting the blower in case of excessive conditions. They are both constructed in the form of plugs, but are either thermal or pressure actuated, so that a diaphragm member would rupture or break when the temperature or pressure reaches or exceeds certain pre-determined threshold.

For thermally triggered plugs, the diaphragm is made from a solder material having a predictable melting point that corresponds to the maximum temperature permissible in the discharge gas of the blower. For pressure triggered plugs, the diaphragm is a rupture disk that would mechanically break open when pressure differential exceeds the tensile limit of the material.

However, the thermal or pressure triggered plugs used in these existing methods are all one time use plugs. Once they are activated and spent, the blowers must be disabled from operation for certain period of time before new plugs can be re-installed. In addition, there is no audible alarm to alert the failure.

Accordingly, it is always desirable to provide a new design and construction of high pressure rotary blowers that can achieve high pressure rise and pressure ratio while overcome the problems existed in conventional rotary blowers, so that they can operate more safely, efficiently and reliably.

SUMMARY OF THE INVENTION

The present invention is directed to a high pressure rotary blower that utilizes cooling fans on rotor shaft, a high-pressure connecting flange, contact friendly wearable strip seals on rotor surfaces, and an audible warning and relieving mechanism integrated with the casing of the blower.

It is an object of the present invention to provide a new and unique design and construction of a rotary blower that can achieve higher pressure rise and pressure ratio than conventional blowers while not using liquid cooling methods.

It is also an object of the present invention to provide a new and unique design and construction of a rotary blower that utilizes cooling fans on rotor shaft to effectively reduce the high temperature caused by the higher pressure.

It is also an object of the present invention to provide a new and unique design and construction of a rotary blower that has smaller clearance and closely separated and contact friendly interface to increase blower efficiency and reliability.

It is also an object of the present invention to provide a new and unique design and construction of a rotary blower with a raised flange surface that seals higher internal pressure more efficiently while requires less torque to tighten.

It is also an object of the present invention to provide a new and unique design and construction of a rotary blower that is equipped with a reusable pressure activated plug for relieving high pressure gas when the internal pressure of the blower exceeds a predetermined limit.

It is also an object of the present invention to provide a new and unique design and construction of a rotary blower that provides audible warning after the pressure relieving plug has been triggered.

In a preferred embodiment of the present invention, the high pressure rotary blower includes a housing structure with a flow suction port and a flow discharge port and internal flow passage there-between. The housing structure includes an inner enclosed casing and an outer cover with a hollow space there-between and one or more cooling air inlet openings and one or more cooling air outlet openings on the outer cover for passing through cooling air. The present invention high pressure rotary blower also includes two parallel three-lobe rotors rotatably mounted on two parallel rotor shafts respectively inside the inner casing and interconnected through a set of timing gears to rotate in synchronization for propelling flow from the suction port to the discharge port. One or more centrifugal cooling fans are mounted on one of the two rotor shafts at locations adjacent to the inlet and outlet openings of the outer cover for circulating cooling air through the space between the outer cover and the inner casing. The present invention high pressure rotary blower further includes a wearable strip seal device applied on the two three-lobe rotors for preventing internal leakage and accidental mechanical contact. In addition, the present invention rotary blower includes a pressure activated relieving device mounted on the inner casing for relieving internal pressure from the blower when it exceeds a pre-determined threshold and producing an audible alarm, and a high pressure discharge flange for the discharge port of the blower having an end sealing surface with a raised center portion. The present invention high pressure rotary blower is capable of achieving higher pressure rise and higher pressure ratio while reducing high pressure induced high temperature and internal leakage, thereby improving the efficiency and reliability of the blower.

The present invention has many novel and unique features and advantages. It provides a new design and construction of a rotary blower that is capable of achieving higher pressure rise and pressure ratio than conventional blowers, without using the conventional liquid cooling methods. It also provides a rotary type blower that has smaller clearance and closely separated interfaces which are contact friendly, to increase the blower efficiency and reliability. The present invention high pressure rotary blower also effectively reduces the higher pressure induced higher temperature on bearing, gear and oil by utilizing internal cooling fans on the gear shaft. In addition, it seals higher internal pressure more efficiently by using a raised flange surface that also requires less torque to tighten. It further utilizes a pressure activated relieving plug that is reusable and provides an audible warning after the pressure release has been triggered.

These and further novel features and objects of the present invention will become more apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMIENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

As a brief introduction, the present invention high pressure rotary blower includes an inner enclosed casing having a flow suction port and a flow discharge port and an internal bearing support structure, and an outer cover having one or more inlet openings and one or more outlet openings and enclosing the inner casing with a space there-between for cooling air passage. The outer cover has a suction port opening aligned with the suction port of the inner casing and a discharge port opening aligned with the discharge port of the inner casing.

The present invention high pressure rotary blower also includes two parallel three-lobe rotors mounted on two parallel rotor shafts respectively, where the rotor shafts are supported by the internal bearing support structure of the inner casing and interconnected through a set of timing gears to rotate the rotors in synchronization for propelling flow from the suction port to the discharges port. Centrifugal cooling fans are mounted on one of the two rotor shafts at locations adjacent to the inlet and outlet openings of the outer cover for circulating cooling air through the space between the outer cover and the inner casing.

The present invention high pressure rotary blower also includes a wearable strip seal device applied on the two multi-lobe rotors for preventing internal leakage and accidental mechanical contact.

Additionally, the present invention high pressure rotary blower includes a pressure activated relieving device mounted on the inner casing for relieving internal pressure from the blower when it exceeds a pre-determined threshold and producing an audible alarm, and a high pressure discharge flange for the discharge port of the blower having an end sealing surface with a raised center portion.

The present invention high pressure rotary blower is capable of achieving higher pressure rise and higher pressure ratio while reducing high pressure induced high temperature and internal leakage, thereby improving the efficiency and reliability of the blower.

Figure 1:
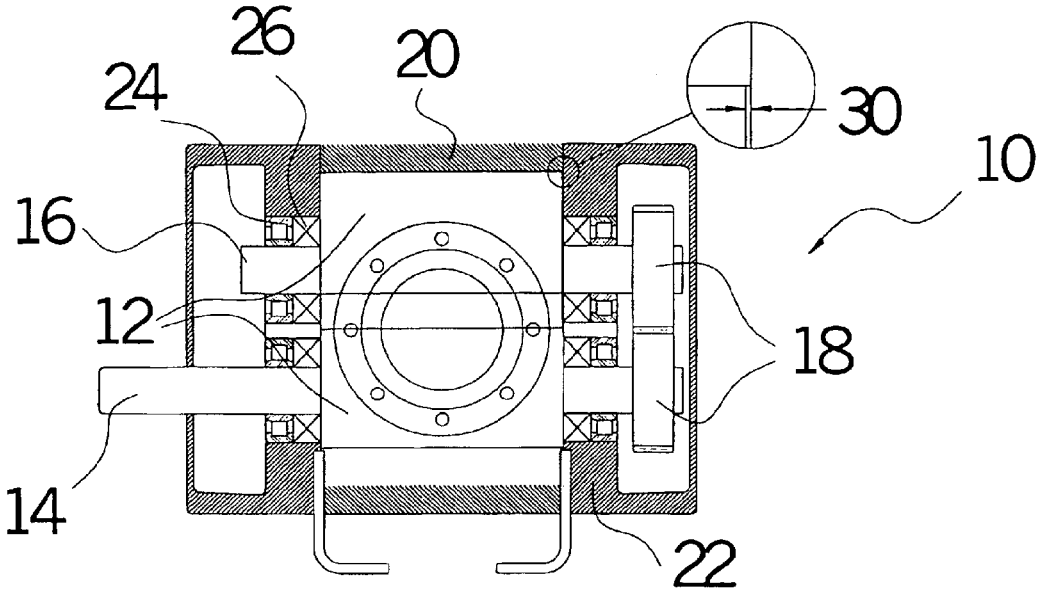
FIG. 1 (PRIOR ART)
FIG. 1 (PRIOR ART) is an illustrative partial cross-sectional side view of a typical arrangement of a conventional rotary blower.
Figure 2:
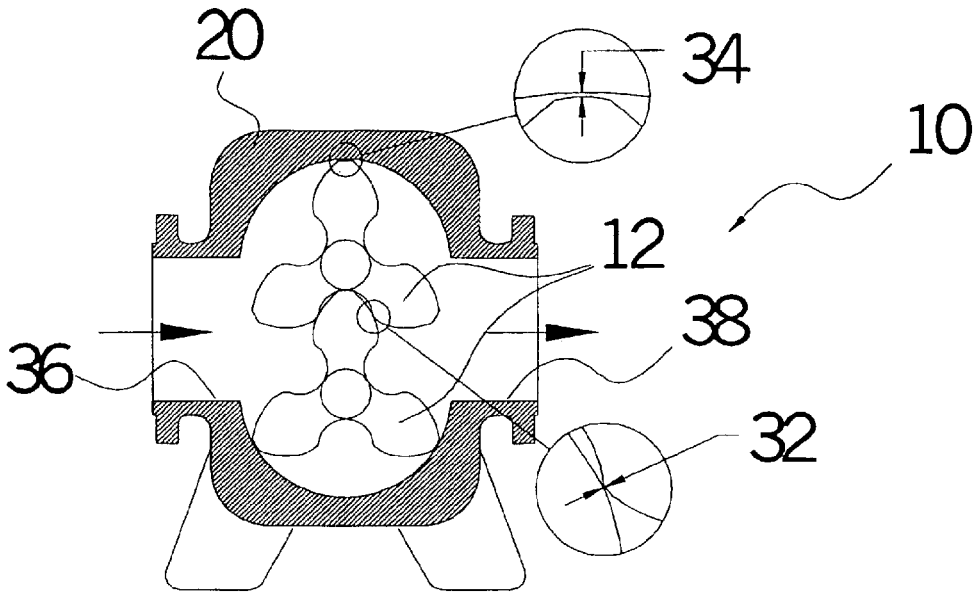
FIG. 2 (PRIOR ART)
FIG. 2 (PRIOR ART) is an illustrative partial cross-sectional end view of the typical arrangement of a conventional rotary blower.

Referring to FIGS. 1 and 2, there is shown a typical arrangement of a prior art rotary blower 10. Typically, the rotary blower 10 has two parallel rotors 12 mounted on rotor shafts 14 and 16 respectively, where rotor shaft 14 is driven by an external rotational driving mechanism (not shown) and through a set of timing gears 18 rotate the rotors 12 in synchronization without touching each other. The rotary blower 10 rotors 12 also has an enclosed casing 20, wherein the rotor shafts 14 and 16 are mounted on an internal bearing support structure 22 with bearings 24 and seals 26.

The gaps between the end surfaces of rotors 12 and the casing 20 are referred to as the "end clearance" 30, the gaps between the two rotors 12 are referred to as the "inter-lobe clearance" 32, and the gaps between the tips of the rotors 12 and the casing 20 are referred to as the "tip clearance" 34.

The arrows show the direction of the flow as propelled by the rotors 12 from a suction port 36 to a discharge port 38 of the blower 10.

Figure 3:
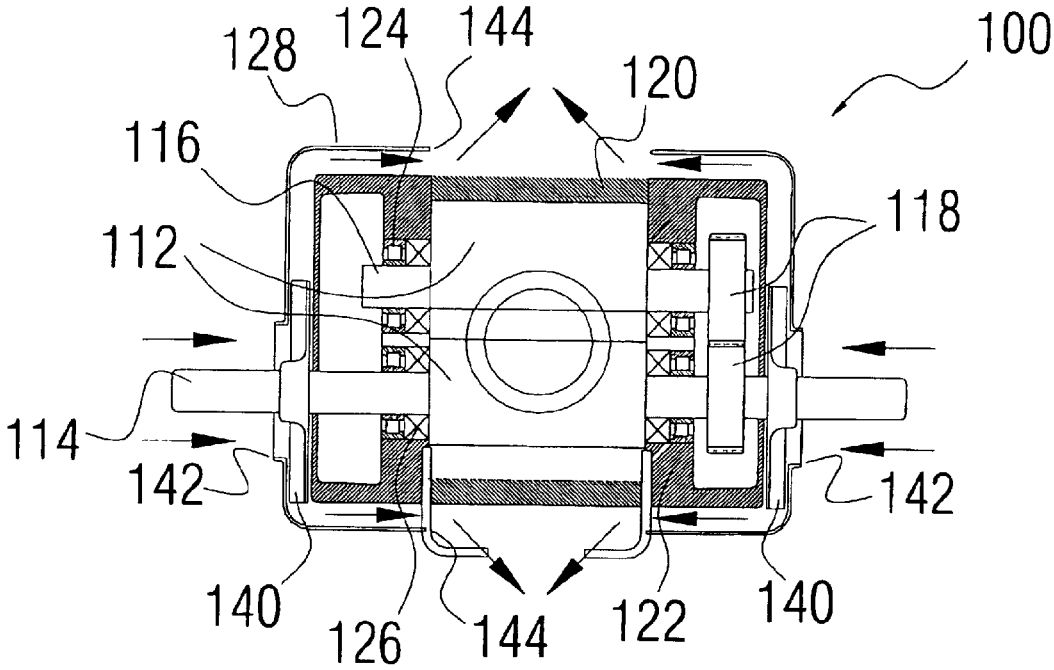
FIG. 3 is an illustrative partial cross-sectional side view of a preferred embodiment of the present invention high pressure rotary blower.
Figure 4:
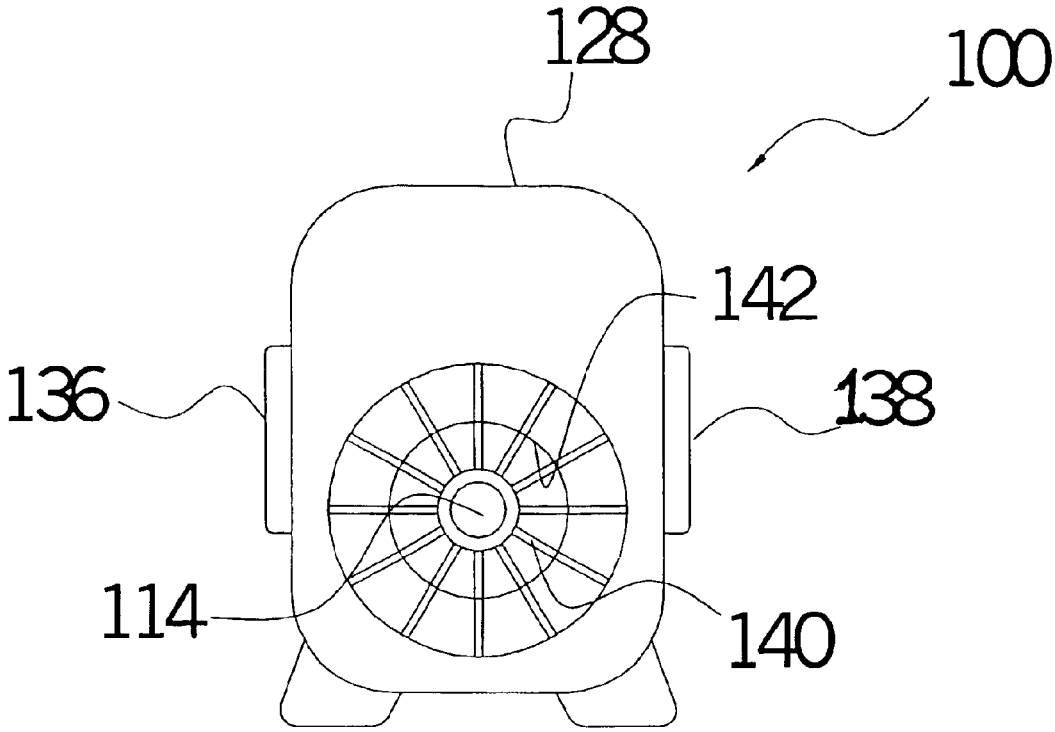
FIG. 4 is an illustrative end view of the preferred embodiment of the present invention high pressure rotary blower.
Figure 5:
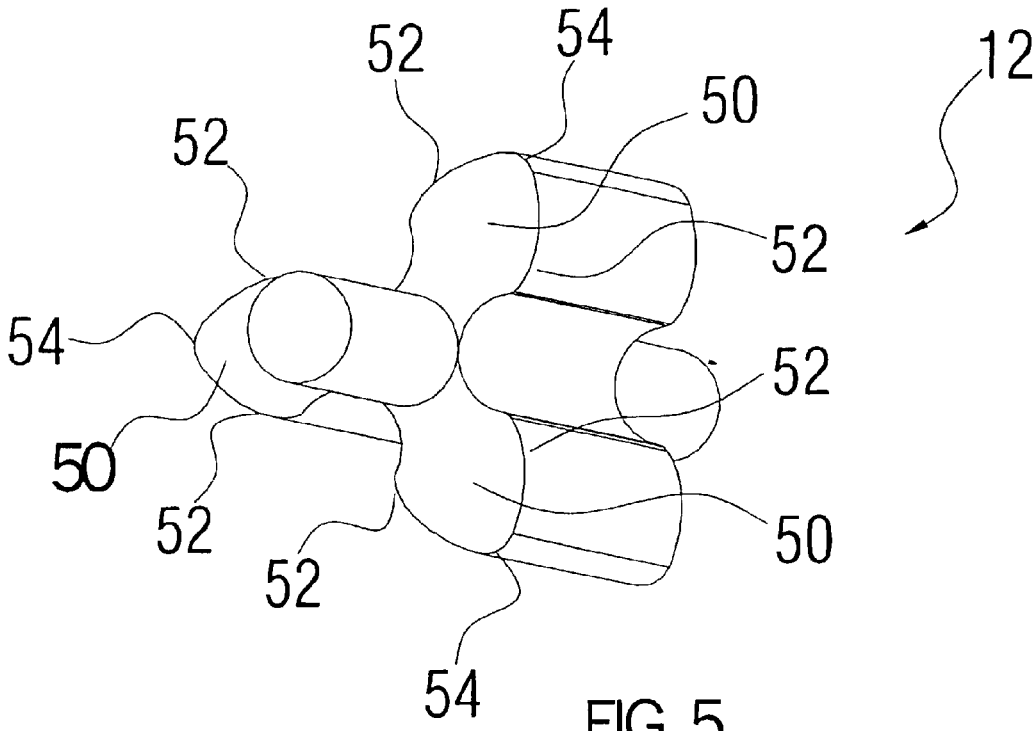
FIG. 5 (PRIOR ART)
FIG. 5 (PRIOR ART) is an illustrative prospective view of a rotor used in a conventional rotary blower.
Figure 6:
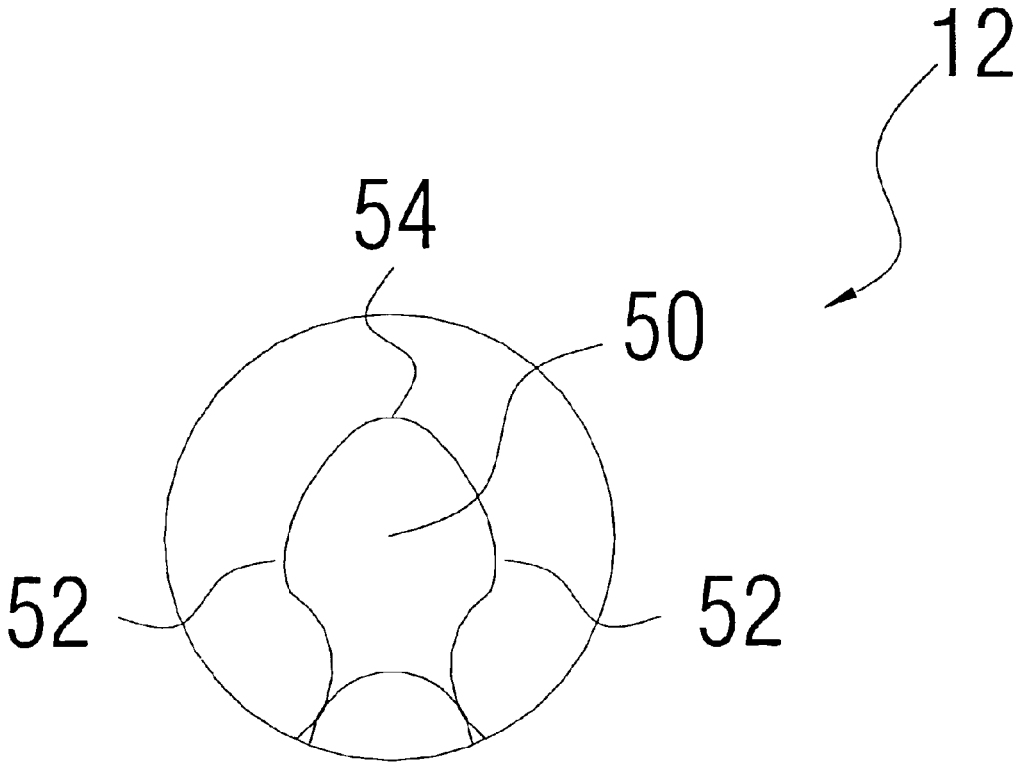
FIG. 6 (PRIOR ART)
FIG. 6 (PRIOR ART) is an enlarged illustrative partial end view of, the rotor used in a conventional rotary blower.

Referring to FIGS. 3 and 4, there is shown a preferred embodiment of the present invention high pressure rotary blower 100. The present invention rotary blower 100 has two parallel 3-lobe rotors 112 mounted on rotor shafts 114 and 116 respectively, where rotor shaft 114 is driven by an external rotational driving mechanism (not shown) and through a set of timing gears 118 rotate the rotors 112 in synchronization without their lobes touching each other for propelling the flow from a suction port 136 to a discharge port 138 of the blower 100.

The present invention rotary blower 100 rotors 112 has a casing structure which includes an inner enclosed casing 120, wherein the rotor shafts 114 and 116 are mounted on an internal bearing support structure 122 with bearings 124 and seals 126. The casing structure further includes an outer cover 128 with al space maintained between the inner casing 120 and the outer cover 128 for passage of cooling air as indicated by the arrows in FIG. 3.

As an important novel and unique feature of the present invention, a set of centrifugal cooling fans 140 are employed on both sides of the blower to provide positive cooling for the blower. The cooling fans are mounted on the extended shaft 114, adjacent to the air inlet openings 142 of the outer cover 128 for bringing in cooling air, which is in turn guided by the outer cover 128 to pass around the inner casing 120 through the space between the outer cover 128 and the inner casing 120 and exists from the air outlet openings 144 of the outer cover 128, as shown by the arrows in FIG. 3. The suction port and discharge port openings of the cover 128 are aligned with the suction and discharge ports of the inner casing 120, respectively.

In general, the discharge temperature of the blower is not only determined by the leakage flow, which is significantly higher for high pressure applications, but also directly proportional to the pressure ratio. The resulting increased heat will enhance the frictional heat generated from the gears and bearings themselves. Therefore, the present invention cooling fans 140 integrated on the rotor shaft 114, with its mechanical simplicity, can positively remove the heat from the blower 100 without using more expensive forced oil lubrication or liquid spraying of the conventional designs.

Another novel and unique feature of the present invention is to utilize multiple and improved wearable strip seals on the rotors 112.

As illustrated in FIGS. 1, 2, 5 and 6, in a prior art rotary blower 10, leakage flow may occur at the end clearance gaps 30 between the end surfaces 50 of rotors 12 and the casing 20, at the inter-lobe gaps 32 between the inter-lobe profiles 52 of the two rotors 12, and at the tip clearance gaps 34 between the tips 54 of the rotors 12 and the casing 20.

Figure 7:
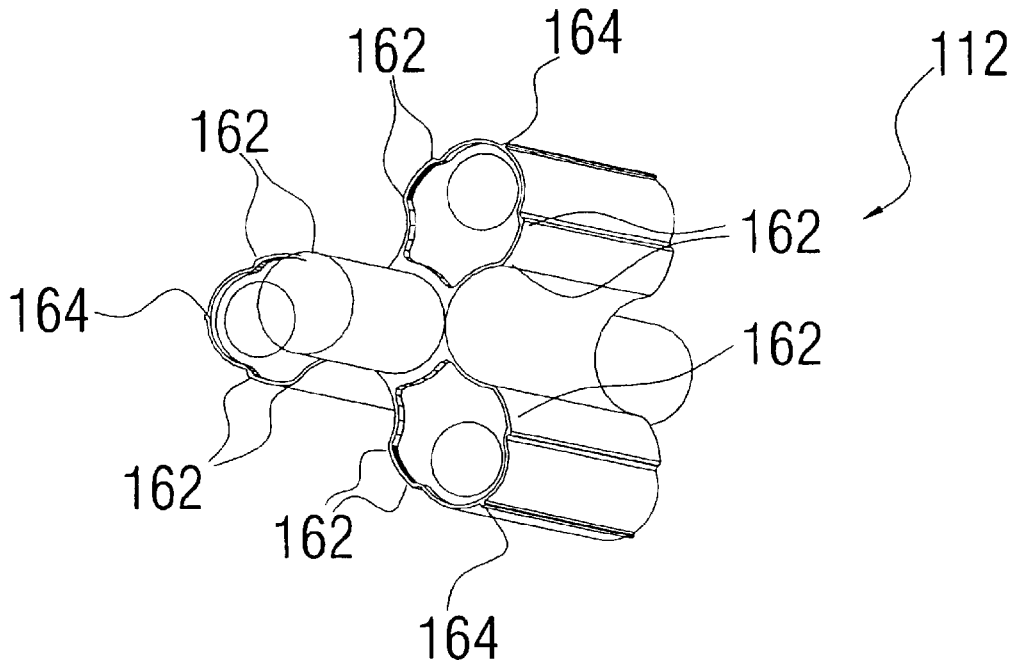
FIG. 7 is an illustrative prospective view of a preferred embodiment of the wearable strip seal provided on the rotor ends in the present invention high pressure rotary blower.
Figure 8:
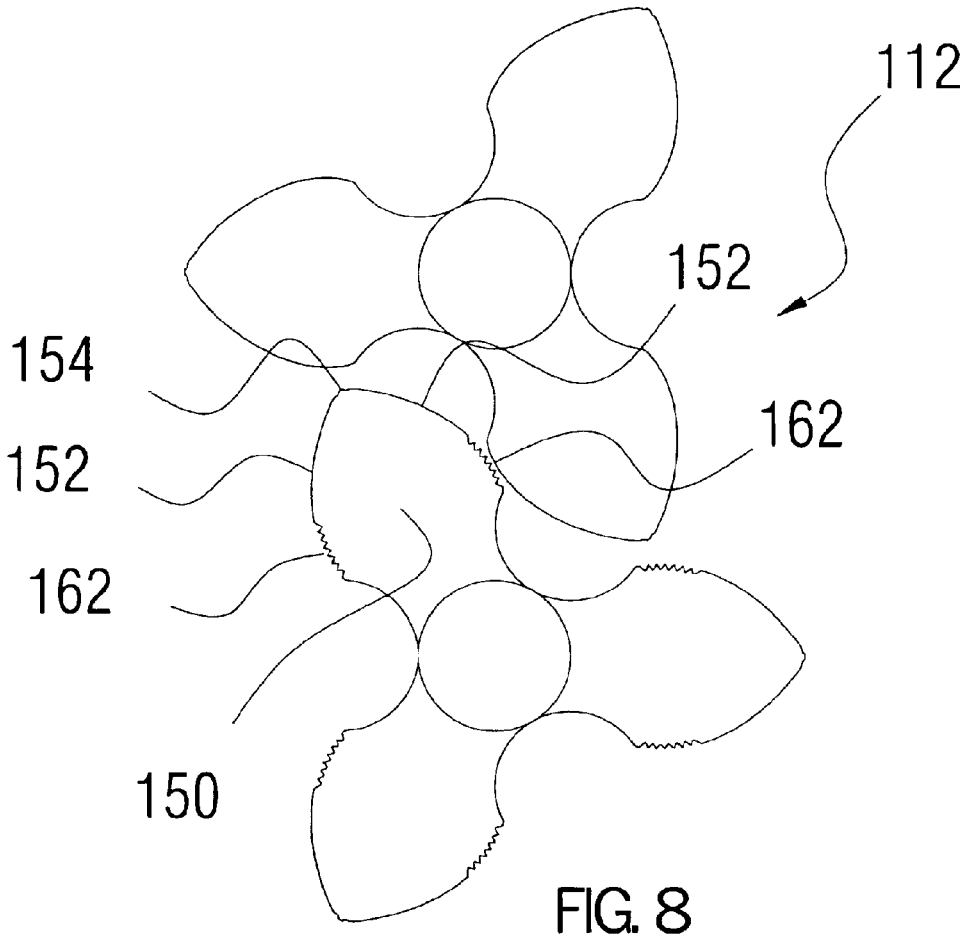
FIG. 8 is an enlarged illustrative partial end view of the preferred embodiment of the wearable strip seal provided on the rotor profile and tip in the present invention high pressure rotary blower.
Figure 9:
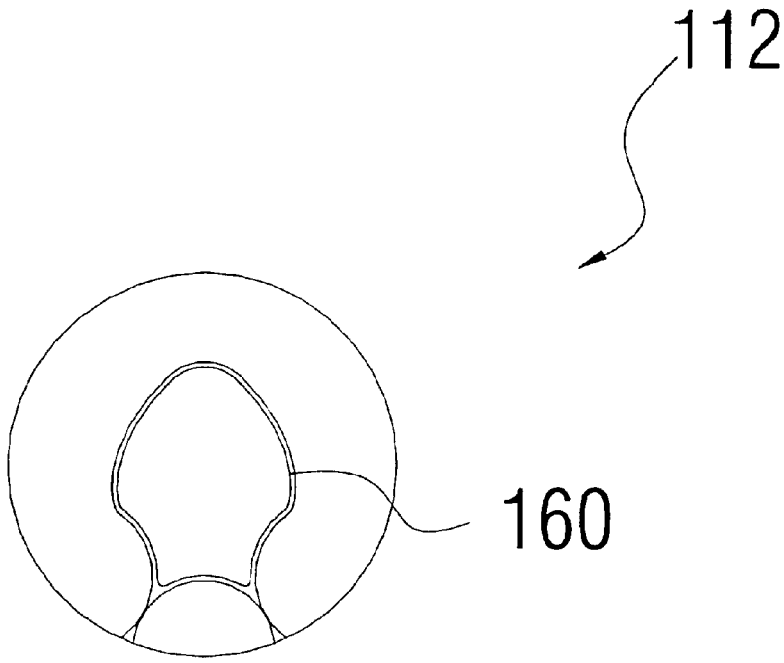
FIG. 9 is an enlarged illustrative partial end view of an alternative embodiment of the wearable strip seal provided on the rotor ends in the present invention high pressure rotary blower.

In the present invention rotary blower 100, new and unique wearable strip seals are utilized to counter the leakage problem. Referring to FIGS. 7 through 9, in one preferred embodiment there are rotor inter-lobe wearable strip seals 162 used on the inter-lobe profiles 152 of the rotor 112.

In addition, or as an alternative embodiment, rotor tip wearable strip seals 164 can be used at the tips 154 of the rotor 112. In further addition, or as another alternative embodiment, rotor end wearable strip seals 160 can be used at the ends 150 of the rotor 112.

Further referring to FIG. 8, it is noted that each rotor with a teethed profile must match or mesh with rotor with a smooth or "unteethed" profile. This is because that if both rotors are having a teethed profile, then they would lock each other up and cause damage to the rotor due to therelative sliding between the rotor surfaces.

With the use of wearable strip seals 160, 162 and 164, surface discontinuity is created in the sliding direction, which reduces contact areas. As a result, a large sealing area becomes a thin sealing line. The new interface is more contact friendly and an accidental contact becomes a wearing process without developing into a full seizure.

In addition, with the use of the wearable strip seals 160, 162 and 164, the present invention rotary blower 100 can have smaller clearances than conventional rotary blowers. As a result, higher pressure can be achieved with a reduced leakage rate, and mechanical reliability of the blower is greatly improved It is also a novel and unique feature of the present invention to utilize a high pressure connecting flange in connection with the rotary blowers 100.

Figure 10:
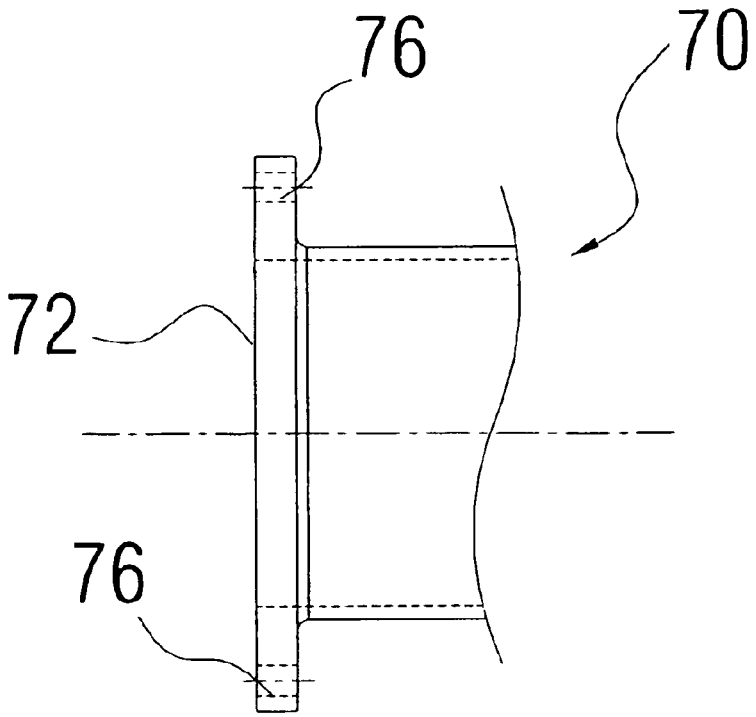
FIG. 10 (PRIOR ART)
FIG. 10 (PRIOR ART) is an illustrative partial side view of a conventional connecting flange used in conjunction with a rotary blower.
Figure 11:
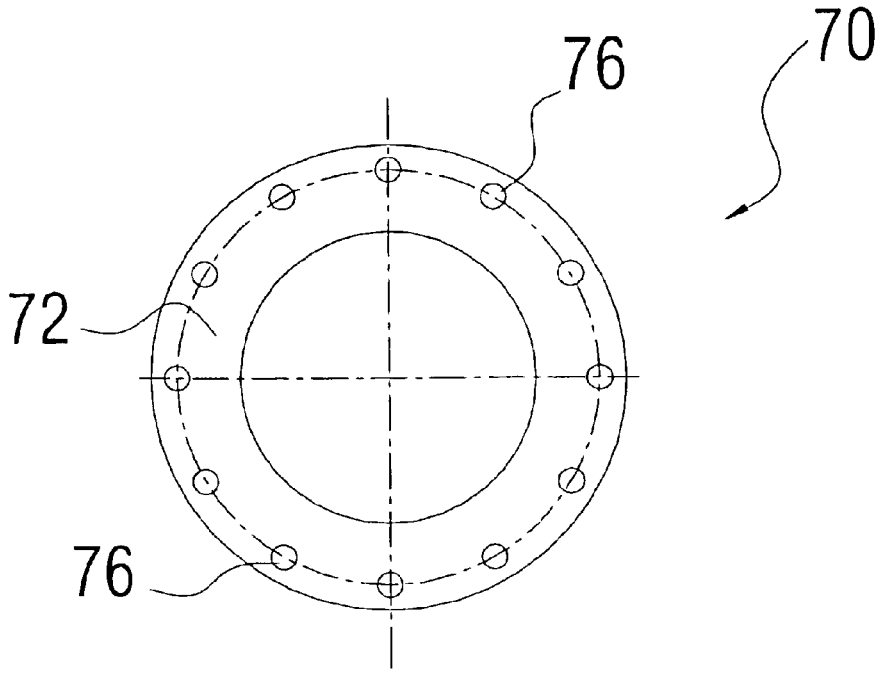
FIG. 11 (PRIOR ART)
FIG. 11 (PRIOR ART) is an illustrative end view of the conventional connecting flange used in conjunction with a rotary blower.

Referring to FIGS. 10 and 11, a conventional blower discharge flange 70 used in conjunction with a rotary blower has an end sealing surface 72 which is flat. When the blower discharging flange 70 is connected to the flange of a discharging pipe (not shown), fasten bolts (not shown) are inserted through the circumferential bolt openings 76 to fasten the flanges. However, because the end sealing surfaces of the flanges are flat, much higher torque is required to tighten the bolts.

Figure 12:
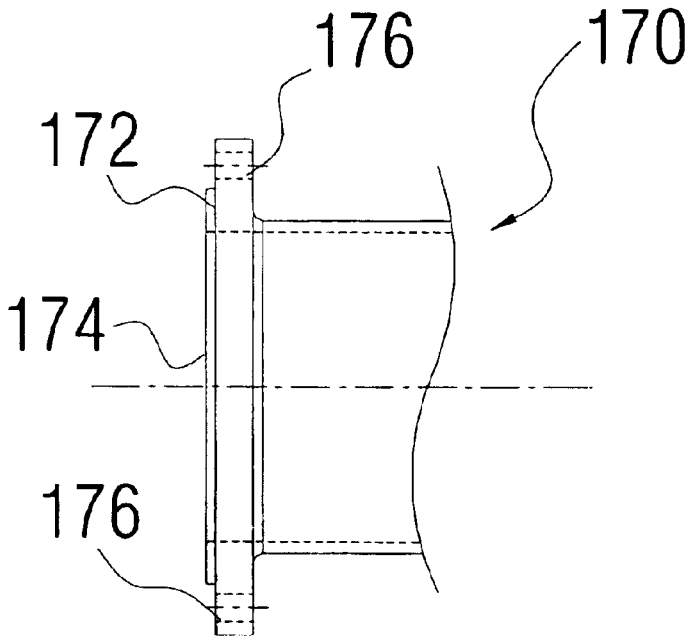
FIG. 12 is an illustrative partial side view of a preferred embodiment of a high pressure connecting flange used in conjunction with a rotary blower of the present invention.
Figure 13:
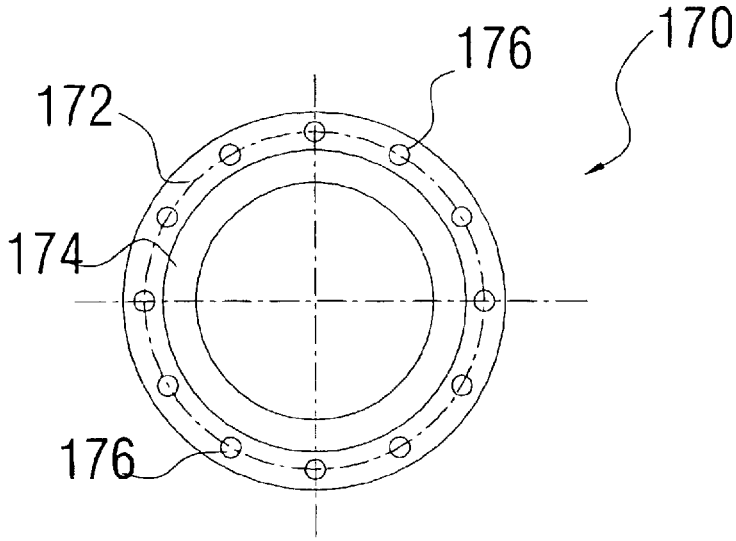
FIG. 13 is an illustrative partial end view of the preferred embodiment of the high pressure connecting flange used in conjunction with a rotary blower of the present invention.

Referring to FIGS. 12 and 13, the present invention utilizes a high pressure discharge flange 170 that has an end sealing surface 172 with a raised center portion 174. In this new design, the end sealing surface 172 is concentrated in the center. As a result, the flange end sealing surfaces seal the high internal pressure of the blower more effectively, and less torque is required to tighten the fasten bolts (not shown) which are inserted through the circumferential bolt openings 176 and tightened to connected the rotary blower discharge flange 170 with the flange of a discharging pipe (not shown).

A further novel and unique feature of the present invention is to utilize a reusable and audible pressure relieve device in conjunction with the present invention rotary blowers 100.

Figure 14:
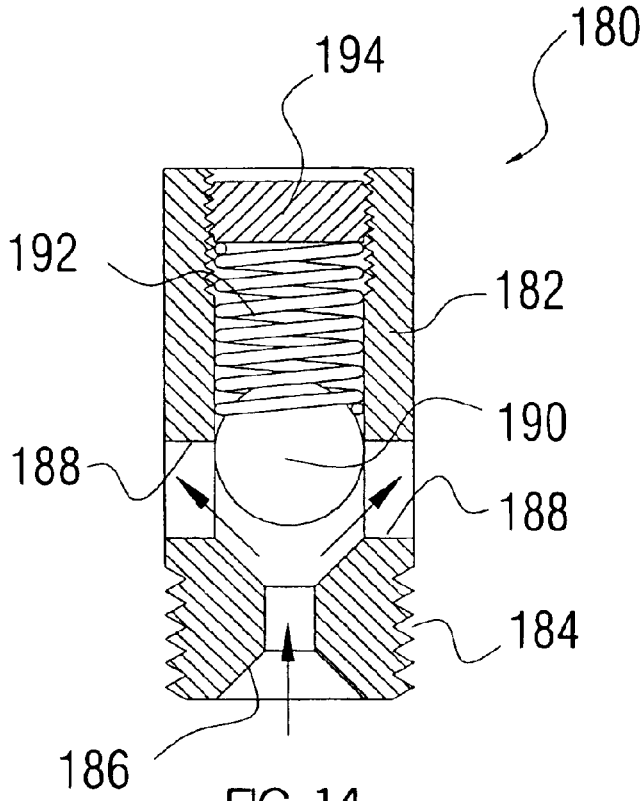
FIG. 14 is an illustrative cross-sectional side view of a preferred embodiment of an audible pressure relieve valve used in conjunction with a rotary blower of the present invention, showing the valve in an open position.
Figure 15:
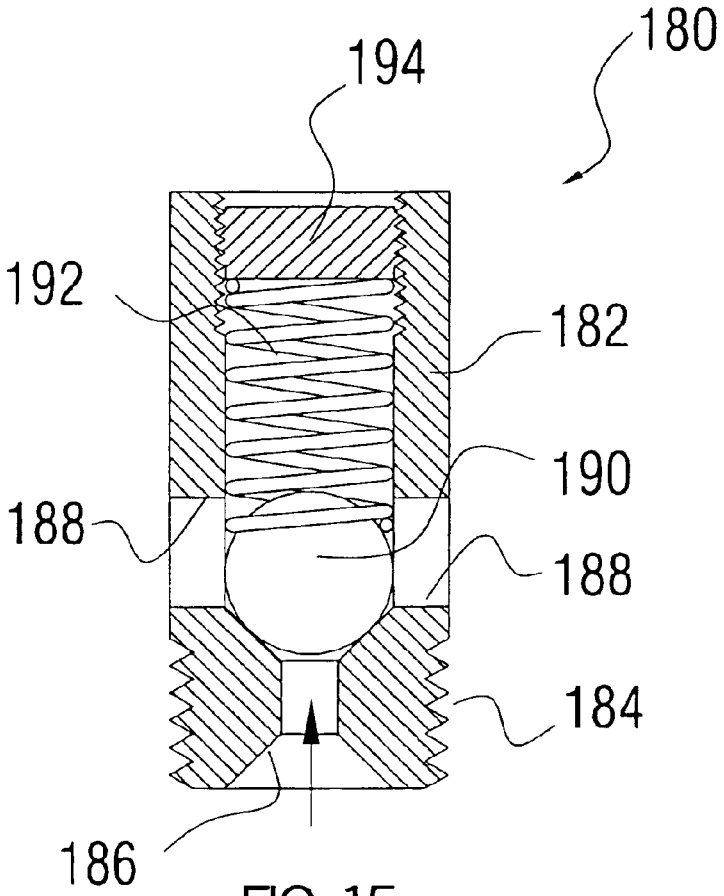
FIG. 15 is an illustrative cross-sectional side view of the preferred embodimnent of the audible pressure relieve valve used in conjunction with a rotary blower of the present invention, showing the valve in a closed position.

Referring to FIGS. 14 and 15, there is shown a preferred embodiment of an audible pressure relieve valve 180 used in conjunction with the present invention rotary blower 100. The audible pressure relief valve 180 is pressure triggered and capable of being used repeatedly. It has a plug housing 1821 with external end screws threads 184 for mounting into an pressure relieve opening of the rotary blower.

When the internal pressure of the rotary blower from the inlet port 186 exceeds a predetermined threshold pressure, the force exerted on the valve ball 190 from the high internal pressure will overcome the force of the internal spring 192 and move the ball 190 to open the pressure relieve ports 188 to relieve the internal pressure. The pressure relieve ports 188 are narrowed to act as whistles when the high pressure flow passes through the valve as indicated by the arrows in FIGS. 14 and 15, to produce an audible alarm for attention.

The audible pressure relieve valve 180 used in conjunction with the present invention rotary blower 100 also has a set screw 194 on its top which can be used to adjust the triggering pressure range for different applications. A scale may be provided on the top end of the screw 194 with pressure readings to facilitate the calibration.

The present invention rotary blower 100 may be operated at speeds' as high as 5,000 rpm, and at discharge pressures as high as 25 psig, which is often associate with temperatures as high as 400° F.

The present invention rotary blower has many advantages. It can achieve higher pressure rise and pressure ratio than conventional blowers while not using liquid cooling or oil lubrication methods. It also utilizes cooling fans on the gear shaft to effectively reduce the high temperature caused by the higher pressure. It further utilizes end, tip and inter-lobe wearable strip seals which results in smaller clearance and closely separated and contact friendly interface. In addition, it utilizes a raised flange surface that seals higher internal pressure more efficiently while requires less torque to tighten. These improved sealing arrangement and additional protection from higher discharge temperature have significantly increased the efficiency and reliability of the blower. Moreover, the present invention rotary blower provides an audible warning after the pressure relieving plug has been triggered. The pressure activated plug is also reusable after, relieving high pressure gas.

Defined in detail, the present invention is high pressure blower, comprising: (a) an inner enclosed casing having a flow suction port and a flow discharge port and an internal bearing support structure; (b) two parallel multi-lobe rotors mounted on two parallel rotor shafts respectively, where the rotor shafts are supported by the internal bearing support structure of said inner casing and interconnected through a set of timing gears to rotate the rotors in synchronization for propelling flow from said suction port to said discharge port; (c) an outer cover having at least one inlet opening and at least one outlet opening and enclosing said inner casing with a space there-between for cooling air passage, and also having a suction port opening aligned with said suction port of said inner casing and a discharge port opening aligned with said discharge port of said inner casing; (d) at least one centrifugal cooling fan mounted on one of said two rotor shafts at a location adjacent to said at least one inlet opening of said outer cover for circulating cooling air through said space between said outer cover and said inner casing; (e) a wearable strip seal device applied on said two multi-lobe rotors for preventing internal leakage and accidental mechanical contact; (f) a pressure activated relieving device mounted on said inner casing for relieving internal pressure from said blower when it exceeds a pre-determined threshold and producing an audible alarm; and (g) a high pressure discharge flange for said discharge port of said blower having an end sealing surface with a raised center portion; (h) whereby said high pressure blower is capable of achieving higher pressure rise and higher pressure ratio while reducing high pressure induced high temperature and internal leakage, thereby improving the efficiency and reliability of said blower.

Defined broadly, the present invention is a high pressure blower, comprising: (a) a housing structure having a flow suction port and a flow discharge port and internal flow passage there-between, and an inner enclosed casing and an outer cover with a hollow space there-between and having at least one cooling air inlet opening and at least one cooling air outlet opening on the outer cover for passing through cooling air; (b) two parallel multi-lobe rotors rotatably mounted on two parallel rotor shafts respectively inside said inner casing and interconnected through a set of timing gears to rotate in synchronization for propelling flow from said suction port to said discharge port; (c) at least one centrifugal cooling fan mounted on one of said two rotor shafts at a location adjacent to said at least one inlet opening of said outer cover for circulating cooling air through said space between said outer cover and said inner casing; and (d) a wearable strip seal device applied on said two multi-lobe rotors for preventing internal leakage and accidental mechanical contact; (e) whereby said high pressure blower is capable of achieving higher pressure rise and higher pressure ratio while reducing high pressure: induced high temperature and internal leakage, thereby improving the efficiency and reliability of said blower.

Defined more broadly, the present invention is a high pressure blower, comprising: (a) a housing structure having a flow suction port and a flow discharge port and internal flow passage there-between, and an inner enclosed casing and an outer cover with a hollow space there-between and having at least one cooling air inlet opening and at least one cooling air outlet opening on the outer cover for passing through cooling air; (b) at least two parallel multi-lobe rotors rotatably mounted on at least two parallel rotor shafts respectively inside said inner casing and interconnected through a set of timing gears to rotate in synchronization for propelling flow from said suction port to said discharge port; and (c) at least one centrifugal cooling fan mounted on one of said at least two rotor shafts at a location adjacent to said at least one cooling air inlet opening of said housing structure for circulating cooling air through said space between said outer cover and said inner casing; (d) whereby said high pressure blower is capable of achieving higher pressure rise and higher pressure ratio while reducing high pressure induced high temperature and internal leakage, thereby improving the efficiency and reliability of said blower.

Also defined more broadly, the present invention is a high pressure blower, comprising: (a) a housing structure having a flow suction port and a flow discharge port and internal flow passage there-between; (b) at least two parallel multi-lobe rotors rotatably mounted on at least two parallel rotor shafts respectively inside said inner casing and interconnected through a set of timing gears to rotate in synchronization for propelling flow from said suction port to said discharge port; and (c) a wearable strip seal device applied on said two multi-lobe rotors for preventing internal leakage and accidental mechanical contact; (d) whereby said high pressure blower is capable of achieving higher pressure rise and higher pressure ratio while reducing high pressure induced high temperature and internal leakage, thereby improving the efficiency and reliability of said blower.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention.

What is claimed is:

1. A high pressure blower, comprising:

a. a housing structure having a flow suction port and a flow discharge port and internal flow passage there-between;

b. at least two parallel multi-lobe rotors having the same number of straight lobes and rotatably mounted on at least two parallel rotor shafts respectively inside said inner casing and interconnected through a set of timing gears to rotate in synchronization for propelling flow from said suction port to said discharge port; and c. a wearable strip seal device applied on said two multi-lobe rotors for preventing internal leakage and accidental mechanical contact, wherein said wearable strip seal device comprises at least one wearable strip seal member applied on an inter-lobe profile area of each rotor lobe of at least one of said at least two multi-lobe rotors;

d. whereby said high pressure blower is capable of achieving higher pressure rise and higher pressure ratio while reducing high pressure induced high temperature and internal leakage, thereby improving the efficiency and reliability of said blower.

2. The high pressure blower as claimed in claim 1, wherein said at least one wearable strip seal member applied on an inter-lobe profile area of each rotor lobe of at least one of said at least two multi-lobe rotors has a teethed profile.

3. A high pressure blower comprising:

a. a housing structure having a flow suction port and a flow discharge port and internal flow passage there-between:

b. at least two parallel multi-lobe rotors having the same number of straight lobes and rotatably mounted on at least two parallel rotor shafts respectively inside said inner casing and interconnected through a set of timing gears to rotate in synchronization for propelling flow from said suction port to said discharge port; and c. a wearable strip seal device applied on said two multi-lobe rotors for preventing internal leakage and accidental mechanical contact, wherein said wearable strip seal device comprises at least one wearable strip seal member applied on an end surface of each rotor lobe of said at least two multi-lobe rotors, d. whereby said high pressure blower is capable of achieving higher pressure rise and higher pressure ratio while reducing high pressure induced high temperature and internal leakage, thereby improving the efficiency and reliability of said blower.

4. A high pressure blower, comprising:

a. an inner enclosed casing having a flow suction port and a flow discharge port, and an internal bearing support structure;

b. two parallel multi-lobe rotors having the same number of straight lobes and mounted on two parallel rotor shafts respectively, where the rotor shafts are supported by the internal bearing support structure of said inner casing and interconnected through a set of timing gears to rotate the rotors in synchronization for propelling flow from said suction port to said discharge port;

c. an outer cover having at least one inlet opening and at least one outlet opening and enclosing said inner casing with a space there-between for cooling air passage, and also having a suction port opening aligned with said suction port of said inner casing and a discharge port opening aligned with said discharge port of said inner casing;

d. at least one centrifugal cooling fan mounted on one of said two rotor shafts at a location adjacent to said at least one inlet opening of said outer cover for circulating cooling air through said space between said outer cover and said inner casing;

e. a wearable strip seal device applied on said two multi-lobe rotors for preventing internal leakage and accidental mechanical contact, wherein said wearable strip seal device comprises at least one wearable strip seal member applied on an inter-lobe profile area of each rotor lobe of at least one of said two multi-lobe rotors;

f. a pressure activated relieving device mounted on said inner casing for relieving internal pressure from said blower when it exceeds a pre-determined threshold and producing an audible alarm; and g. a high pressure discharge flange for said discharge port of said blower having an end sealing surface with a raised center portion;

h. whereby said high pressure blower is capable of achieving higher pressure rise and higher pressure ratio while reducing high pressure induced high temperature and internal leakage, thereby improving the efficiency and reliability of said blower.

5. The high pressure blower as claimed in claim 4, wherein said at least one wearable strip seal member applied on an inter-lobe profile area of each rotor lobe of at least one of said two multi-lobe rotors has a teethed profile.

6. A high pressure blower, comprising:

a. an inner enclosed casing having a flow suction port and a flow discharge port and an internal bearing support structure:

b. two parallel multi-lobe rotors having the same number of straight lobes and mounted on two parallel rotor shafts respectively where the rotor shafts are supported by the internal bearing support structure of said inner casing and interconnected through a set of timing gears to rotate the rotors in synchronization for propelling flow from said suction port to said discharge port:

c. an outer cover having at least one inlet opening and at least one outlet opening and enclosing said inner casing with a space there-between for cooling air passage, and also having a suction port opening aligned with said suction port of said inner casing and a discharge port opening aligned with said discharge port of said inner casing, d. at least one centrifugal cooling fan mounted on one of said two rotor shafts at a location adjacent to said at least one inlet opening of said outer cover for circulating cooling air through said space between said outer cover and said inner casing:

e. a wearable strip seal device applied on said two multi-lobe rotors for preventing internal leakage and accidental mechanical contact, wherein said wearable strip seal device comprises at least one wearable strip seal member applied on an end surface of each rotor lobe of said two multi-lobe rotors;

f. a pressure activated relieving device mounted on said inner, casing for relieving internal pressure from said blower when it exceeds a pre-determined threshold and producing an audible alarm; and g. a high pressure discharge flange for said discharge port of said blower having an end sealing surface with a raised center portion;

h. whereby said high pressure blower is capable of achieving higher pressure rise and higher pressure ratio while reducing high pressure induced high temperature and internal leakage, thereby improving the efficiency and reliability of said blower.

7. A high pressure blower, comprising:

a. a housing structure having a flow suction port and a flow discharge port and internal flow passage there-between, and an inner enclosed casing and an outer cover with a hollow space there-between and having at least one cooling air inlet opening and at least one cooling air outlet opening on the outer cover for passing through cooling air;

b. two parallel multi-lobe rotors having the same number of straight lobes and rotatably mounted on two parallel rotor shafts respectively inside said inner casing and interconnected through a set of timing gears to rotate in synchronization for propelling flow from said suction port to said discharge port;

c. at least one centrifugal cooling fan mounted on one of said two rotor shafts at a location adjacent to said at least one inlet opening of said outer cover for circulating cooling air through said space between said outer cover and said inner casing; and d. a wearable strip seal device applied on said two multi-lobe rotors for preventing internal leakage and accidental mechanical contact, wherein said wearable strip seal device comprises at least one wearable strip seal member applied on an inter-lobe profile area of each rotor lobe of at least one of said two multi-lobe rotors;

e. whereby said high pressure blower is capable of achieving higher pressure rise and higher pressure ratio while reducing high pressure induced high temperature and internal leakage, thereby improving the efficiency and reliability of said blower.

8. The high pressure blower as claimed in claim 7, wherein said at least one wearable strip seal member applied on an inter-lobe profile area of each rotor lobe of at least one of said two multi-lobe rotors has a teethed profile.

9. A high pressure blower comprising:

a. a housing structure having a flow suction port and a flow discharge port and internal flow passage there-between, and an inner enclosed casing and an outer cover with a hollow space there-between and having at least one cooling air inlet opening and at least one cooling air outlet opening on the outer cover for passing through cooling air;

b. two parallel multi-lobe rotors having the same number of straight lobes and rotatably mounted on two parallel rotor shafts respectively inside said inner casing and interconnected through a set off timing gears to rotate in synchronization for propelling flow from said suction port to said discharge port;

C. at least one centrifugal cooling fan mounted on one of said two rotor shafts at a location adjacent to said at least one inlet opening of said outer cover for circulating cooling air through said space between said outer cover and said inner casing: and d. a wearable strip seal device applied on said two multi-lobe rotors for preventing internal leakage and accidental mechanical contact, wherein said wearable strip seal device comprises at least one wearable strip seal member applied on an end surface of each rotor lobe of said two multi-lobe rotors, e. whereby said high pressure blower is capable of achieving higher pressure rise and higher pressure ratio while reducing high pressure induced high temperature and internal leakage, thereby improving the efficiency and reliability of said blower.

* * * * *